US010395565B2

(12) United States Patent
Yu

(10) Patent No.: US 10,395,565 B2
(45) Date of Patent: Aug. 27, 2019

(54) HARDCASE LUGGAGE WITH BUILT-IN NAME TAG COMPARTMENT

(71) Applicant: Olympia International, Inc., Torrance, CA (US)

(72) Inventor: Chris Yu, Torrance, CA (US)

(73) Assignee: Olympia International, Inc., Torrance, CA (US)

( * ) Notice: Subject to any disclaimer, the term of this patent is extended or adjusted under 35 U.S.C. 154(b) by 48 days.

(21) Appl. No.: 15/700,037

(22) Filed: Sep. 8, 2017

(65) Prior Publication Data

US 2019/0080632 A1 Mar. 14, 2019

(51) Int. Cl.

| | |
|---|---|
| ***A45C 13/00*** | (2006.01) |
| ***G09F 3/20*** | (2006.01) |
| ***A45C 5/03*** | (2006.01) |
| ***A45C 5/14*** | (2006.01) |
| ***A45C 13/42*** | (2006.01) |
| *G09F 3/02* | (2006.01) |

(52) U.S. Cl.

CPC ..... *G09F 3/201* (2013.01); *A45C 5/03* (2013.01); *A45C 5/14* (2013.01); *A45C 13/42* (2013.01); *A45C 2005/037* (2013.01); *G09F 2003/0254* (2013.01)

(58) Field of Classification Search

CPC ... G09F 3/201; G09F 2003/0254; A45C 5/03; A45C 5/14; A45C 2005/037

See application file for complete search history.

(56) References Cited

U.S. PATENT DOCUMENTS

| | | | | | |
|---|---|---|---|---|---|
| 20,259 | A * | 5/1858 | Dudley | G09F 3/18 | 40/653 |
| 2,375,027 | A * | 5/1945 | Naidech | A45D 40/264 | 132/317 |
| 2,718,911 | A * | 9/1955 | Solomon | A45C 1/06 | 150/138 |
| 3,502,089 | A * | 3/1970 | Paradis | A45D 33/20 | 132/294 |
| 4,037,940 | A * | 7/1977 | Yates | G02B 25/008 | 359/672 |
| 4,700,840 | A * | 10/1987 | Haddock | G11B 33/04 | 206/307 |
| 5,054,505 | A * | 10/1991 | Yuhara | A45D 40/18 | 132/294 |
| 6,431,512 | B1 * | 8/2002 | Fox | A47B 21/0314 | 108/50.02 |
| 6,629,588 | B2 * | 10/2003 | Nykoluk | A45C 13/28 | 190/101 |

(Continued)

*Primary Examiner* — Tri M Mai

(74) *Attorney, Agent, or Firm* — Lee, Hong, Degerman, Kang & Waimey

(57) ABSTRACT

A luggage container with built-in external compartment, which includes a case having an outer side and an inner side and a drawer configured to be slid in and out of the case. The case includes a coupling portion formed on the inner side, the coupling portion protruding from the inner side, and the coupling portion is shaped to receive a fastening element. The case is shaped to form a space between a surface of an object onto which the case is coupled and a surface of the inner side to receive the drawer. The drawer is shaped to remain within the case when the drawer is pulled out of the case such that the case and the drawer are not separated even when the drawer is pulled out maximally.

20 Claims, 8 Drawing Sheets

(56) References Cited

U.S. PATENT DOCUMENTS

| | | | | |
|---|---|---|---|---|
| 6,848,577 | B2 * | 2/2005 | Kawamura | A24F 15/12 206/37 |
| 7,537,110 | B2 * | 5/2009 | Kutsch | A24F 23/00 206/38 |
| 2004/0148837 | A1 * | 8/2004 | Lewis | G09F 3/20 40/654.01 |
| 2009/0084012 | A1 * | 4/2009 | Kung | G09F 3/20 40/642.02 |
| 2018/0049409 | A1 * | 2/2018 | Sporn | A01K 27/008 |

* cited by examiner

HARDCASE LUGGAGE WITH BUILT-IN NAME TAG COMPARTMENT

BACKGROUND OF THE INVENTION

Field

The present invention relates generally to a luggage container with a built-in tag or an external compartment for storing an item. More specifically, the present invention relates to hard case luggage containers that have a built-in tag or compartment.

Background

A challenge to traveling has always been carrying one's belongings in the most efficient and easy manner. There are so many similar bags at airports and bags are subject to loss. Bags are lost for a variety of reasons. Among the most common causes is bag-tag mix-up. Therefore, it is very important to have proper identification information on luggage, making finding the luggage at the baggage claim much easier and reducing the chance someone else will take the wrong luggage accidentally.

Although luggage tags that can be tied or attached to the luggage are available, they are prone to damages and they have to be obtained separately because they do not usually come with the luggage. Further, personal information put on the luggage tags are exposed so that anyone can see the information written on the luggage tags. Even if the luggage tags are equipped with a flap that covers the information, usually the tags are hung around a handle and it may hinder a user from holding the handle.

Some softside luggage containers or canvas bags made of flexible materials that are flexible under pressure may have a built-in compartment that is stitched to an outer surface of the luggage such that a business card or a paper with identification information may be inserted into the compartment. Lately, hardside, hard case, or hardshell luggage containers are popular. For example, hard cases are usually made of polycarbonate and no exterior pocket is provided to the hard case luggage contrary to the canvas bags that are generally provided with at least one exterior pocket. Similarly, most hard case luggage, if not all, are not provided with a built-in tag.

Therefore, a solution is necessary to avoid such inconvenience and to prevent loss of the luggage.

SUMMARY OF THE INVENTION

According to one embodiment of the present invention, a wheel assembly includes: a first body; a second body rotatably coupled with the first body such that an angle between the first body and the second body is changeable according to movement of the second body with respect to the first body; a wheel rotatably coupled to the second body; and a rod rotatably coupled with the first body such that the rod is movable with respect to the first body when the wheel assembly is not fully assembled, wherein: the wheel is coupled to the second body via a first pivot pin; the second body is coupled with the first body via a second pivot pin; and the rod is coupled with the first body via a third pivot pin.

According to another embodiment of the present invention, a wheel assembly includes: a first body having a first end portion and a second end portion; a second body having a third end portion and a fourth end portion, the third end portion of the second body rotatably coupled to the second end portion of the first body via a first pivot pin; a wheel rotatably coupled to the second body via a second pivot pin; a rod having a fifth end portion and a sixth end portion, the fifth end portion coupled with the first body via a third pivot pin; a first coiled spring having a first end contacting the first body and a second end contacting the third end portion of the second body; and a second coiled spring having a third end, the rod inserted into the second coiled spring via the third end, and a fourth end contacting the fourth end portion of the second body, wherein an angle between the first body and the second body is changeable according to movement of the second body with respect to the first body, the angle decreased when at least one of the first coiled spring or the second coiled spring is compressed.

According to yet another embodiment of the present invention, a luggage container includes: a wheel holder coupled to a side of the luggage container; and a wheel assembly coupled to the wheel holder, wherein the wheel assembly includes: a first body having a first end portion and a second end portion; a second body having a third end portion and a fourth end portion, the third end portion of the second body rotatably coupled to the second end portion of the first body via a first pivot pin; a wheel rotatably coupled to the second body via a second pivot pin; a rod having a fifth end portion and a sixth end portion, the fifth end portion coupled with the first body via a third pivot pin; a first coiled spring having a first end contacting the first body and a second end contacting the third end portion of the second body; and a second coiled spring having a third end, the rod inserted into the second coiled spring via the third end, and a fourth end contacting the fourth end portion of the second body, wherein an angle between the first body and the second body is changeable according to movement of the second body with respect to the first body, the angle decreased when at least one of the first coiled spring or the second coiled spring is compressed.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF EMBODIMENTS

Hereinafter, the present invention will be described with respect to the embodiment(s) illustrated in the annexed drawings.

Figure 1A:
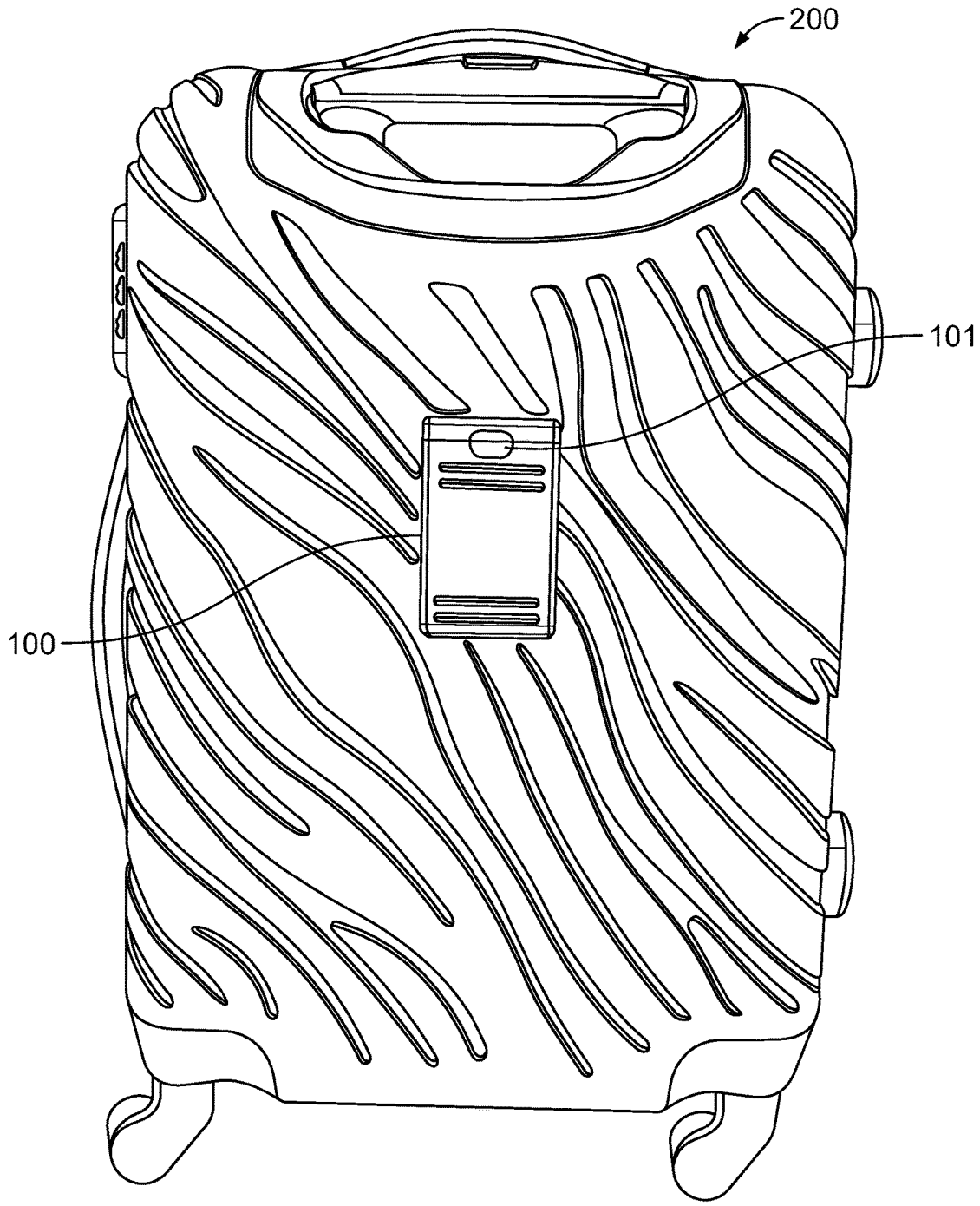
FIGS. 1A and 1B show a luggage container with a built-in tag or compartment according to an embodiment of the present invention.
Figure 1B:
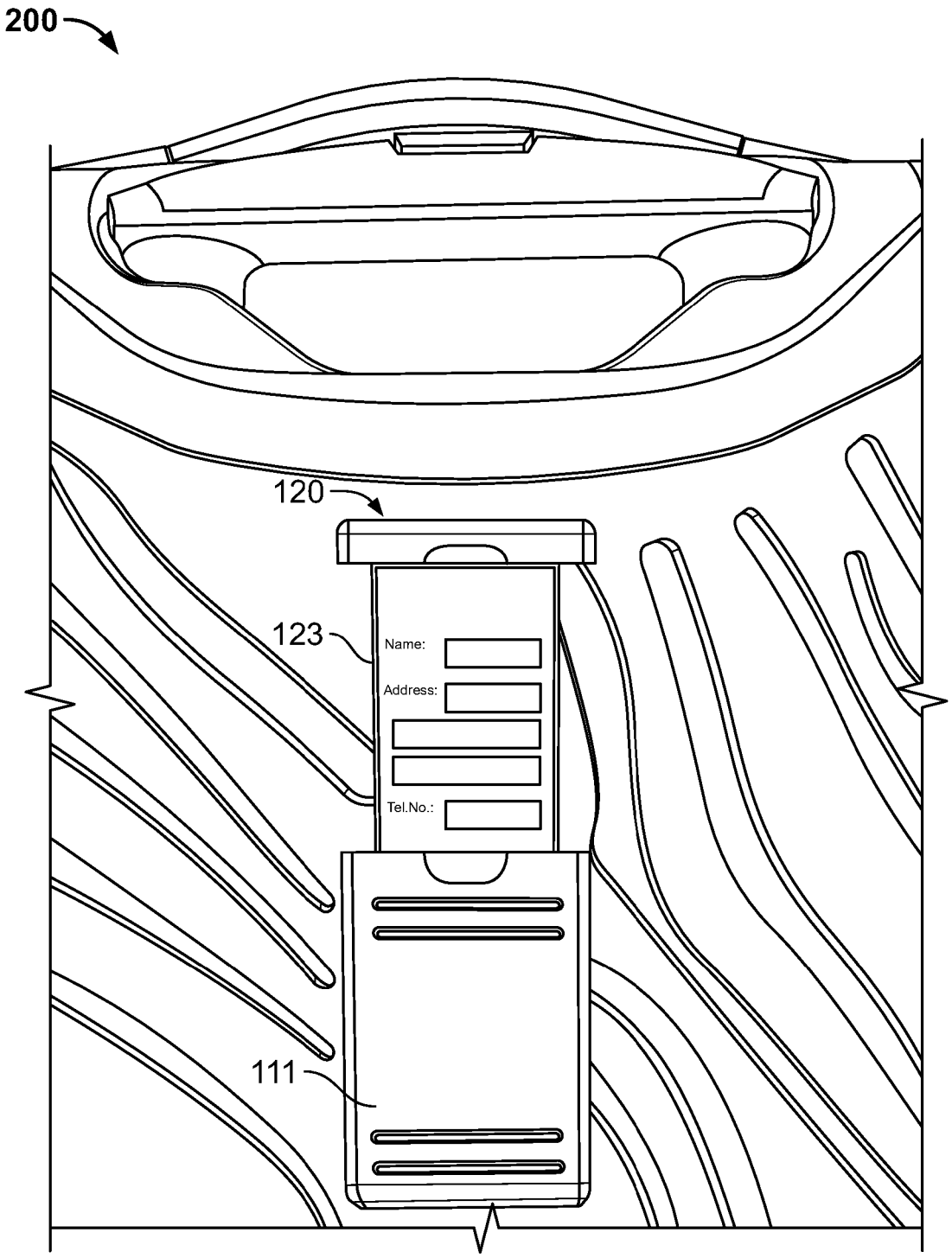

Referring to FIGS. 1A and 1B, a luggage container 200 having a built-in tag or compartment 100 is shown. The luggage container 200 may be any type of luggage container including softside luggage containers and hardside luggage containers. According to an embodiment of the present invention, the luggage container 200 may be preferably a hardside luggage container. For example, the hardside luggage container is made of hard material such as polycarbonate.

Hereinafter, a term "compartment" is used to refer to the built-in tag or an external compartment that can be attached to luggage containers. According to an embodiment of the present invention, the compartment 100 may be made of a material that is same as or similar to the material of the luggage container 200.

Further, the compartment 100 may have a color that is same as a color of the luggage container 200. The compartment 100 may be coupled to any portion of the luggage container 200. That is, the compartment 100 may be coupled to a lateral side, front side, rear side, top side, or bottom side of the luggage container 200. For example, the compartment 100 may be affixed to a portion of the luggage container 200 at which the compartment 100 is readily visible. According to an alternative embodiment of the present invention, the compartment 100 may have a color that is different from the color of the luggage container 200 to make the compartment 100 more visible due to the contrasting colors.

In FIG. 1A, the compartment 100 is shown in a closed configuration. In FIG. 1B, the compartment 100 is shown in an open configuration.

Referring to FIGS. 1A-2C, the compartment 100 includes a case 110 having an outer side 111 and an inner side 112 and a drawer 120 configured to be slid in and out of the case 110. The outer side 111 of the case 110 may be used to put a brand logo or brand name of a manufacturer of the luggage 200. Alternatively, a picture may be printed on the outer side 111 of the case 110.

Figure 2A:
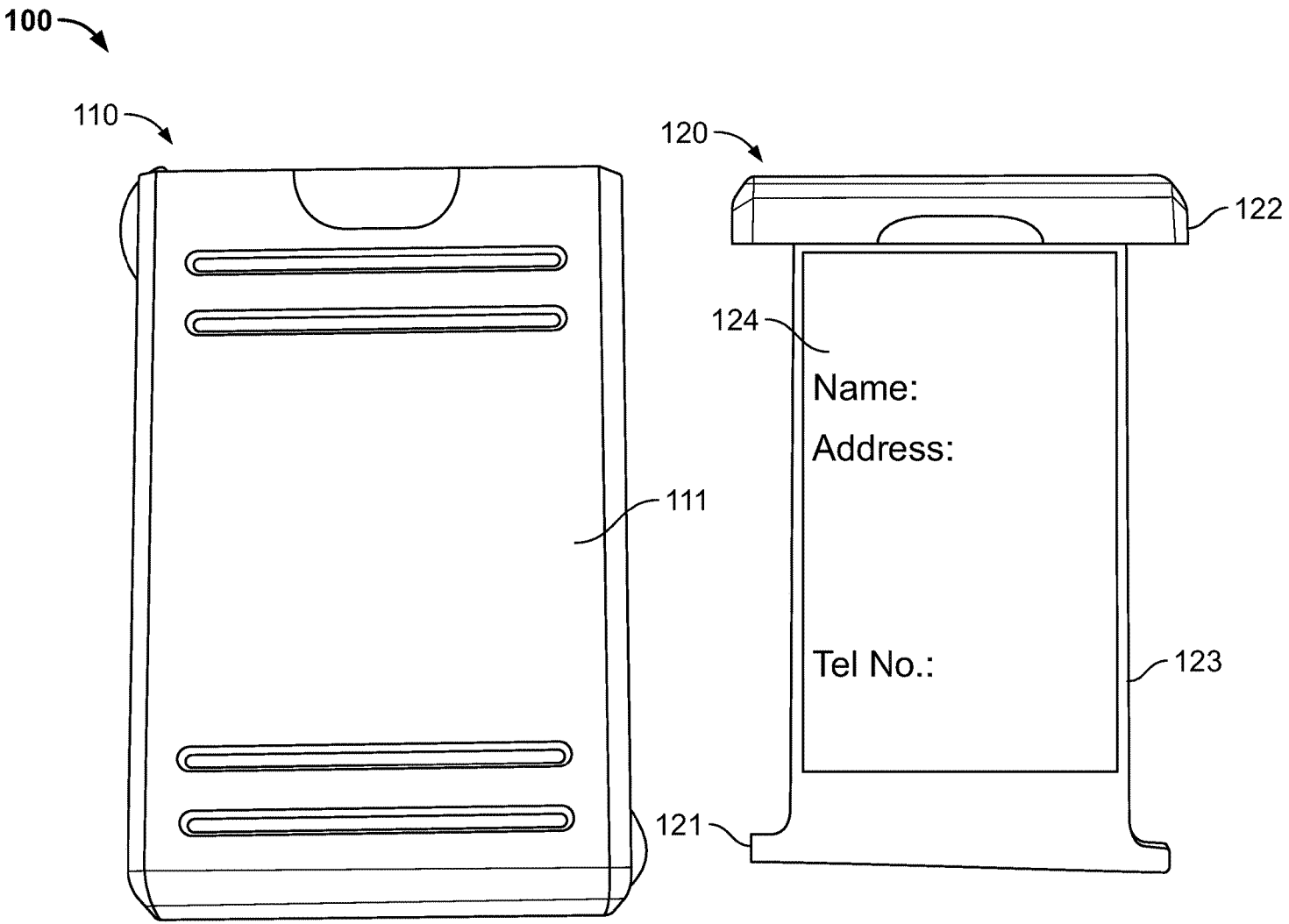
FIGS. 2A-2C shows various views of a compartment according to an embodiment of the present invention.
Figure 2B:
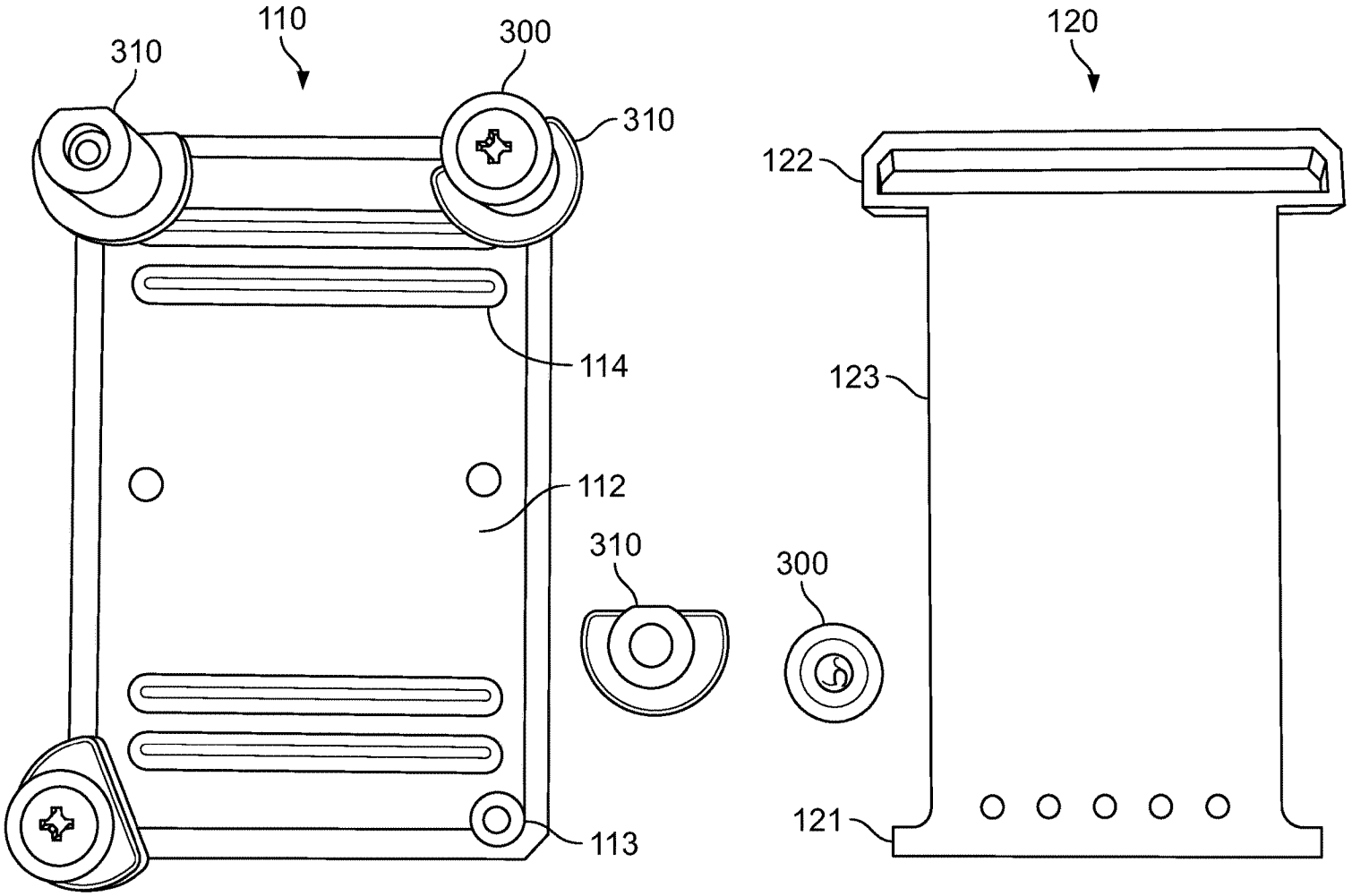
Figure 2C:
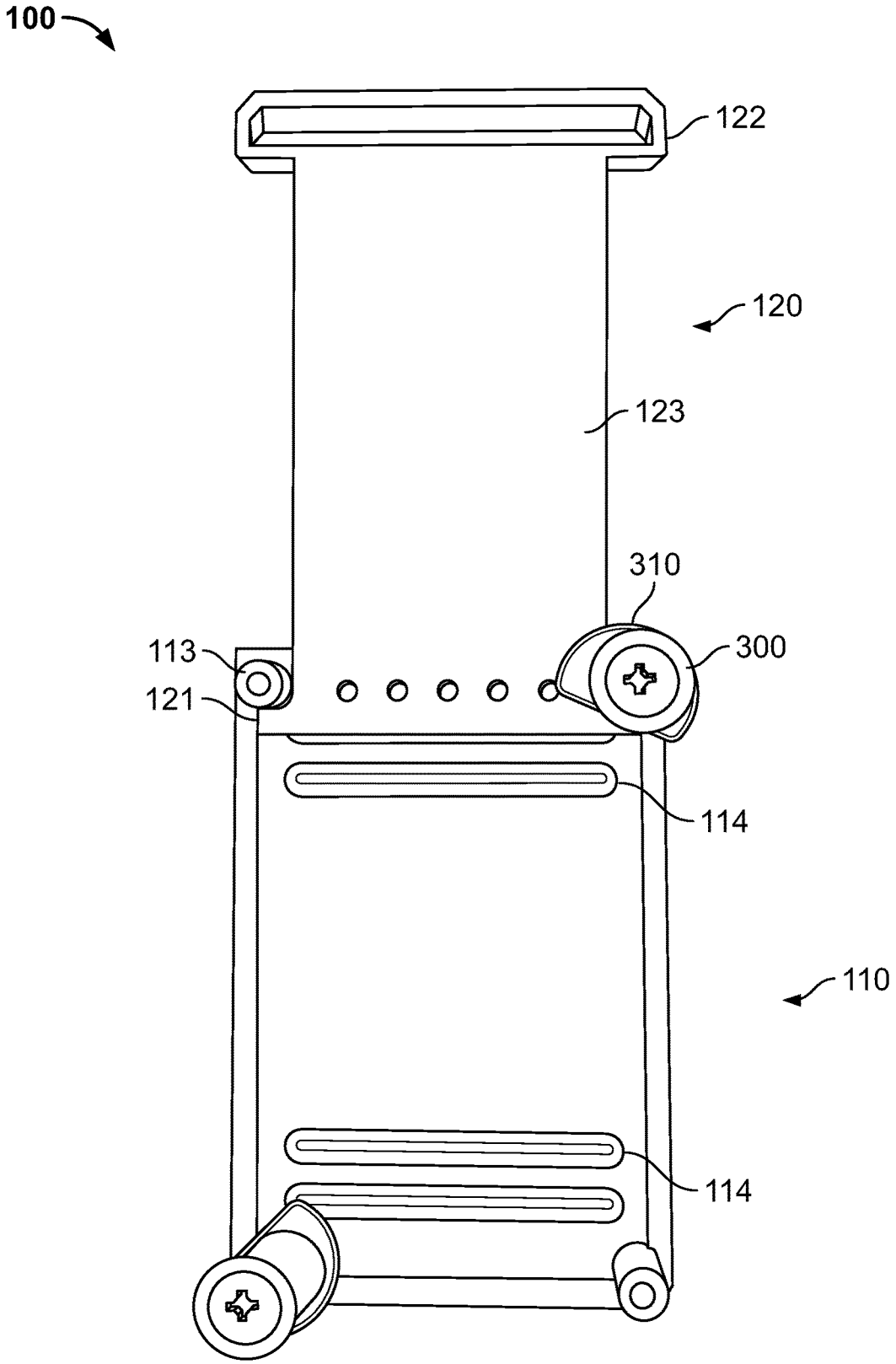

In FIGS. 2A and 2B, it is shown that the compartment 100 is disassembled such that the case 110 and the drawer 120 are separated. Referring to FIGS. 2B and 2C, the case 110 includes at least one coupling portion 113 formed on the inner side 112, the coupling portion protruding from the inner side. The coupling portion 113 is shaped to receive a corresponding fastening element 300.

Figure 3:
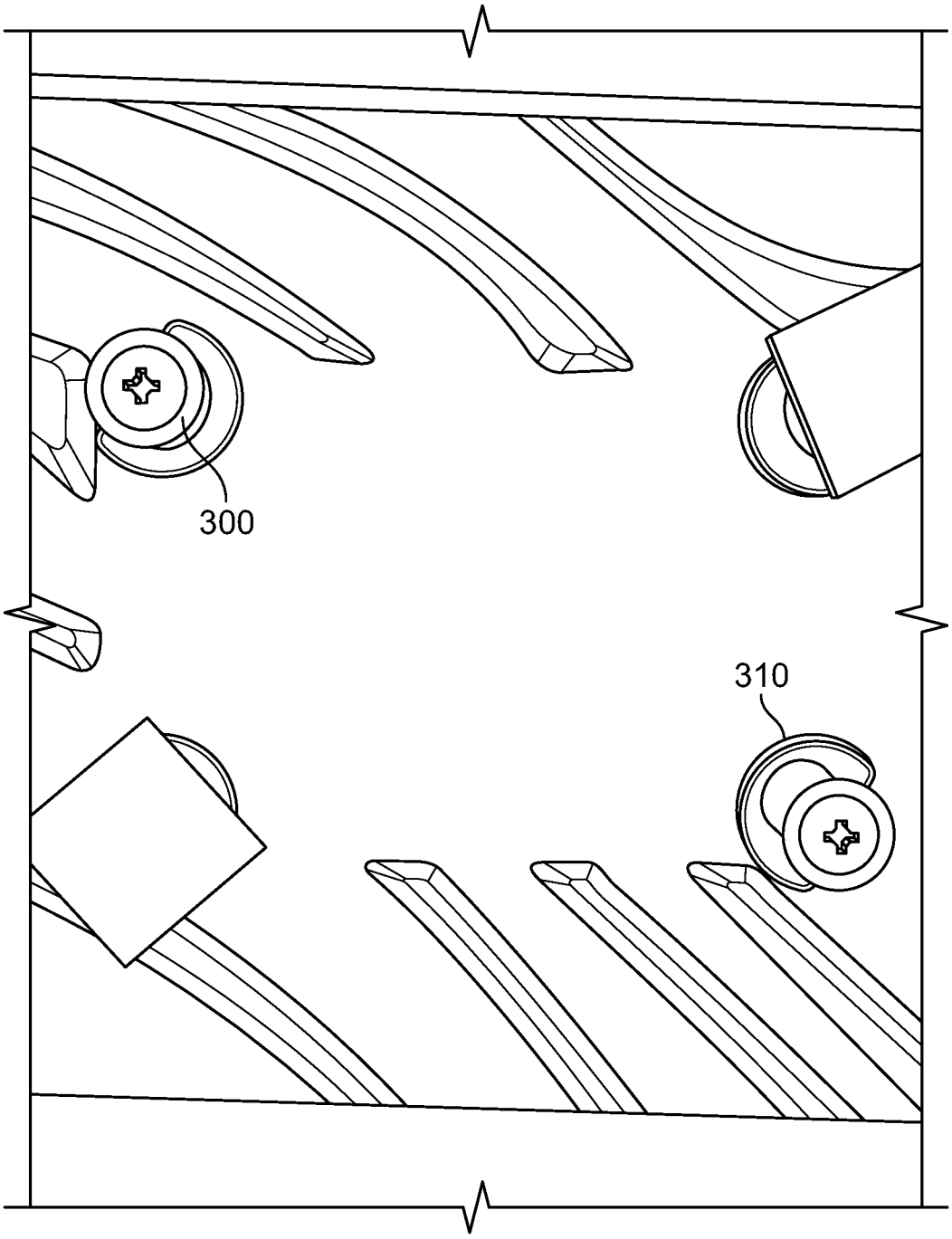
FIG. 3 shows a coupling mechanism used to couple a built-in tag or compartment to a luggage container according to an embodiment of the present invention.
Figure 4:
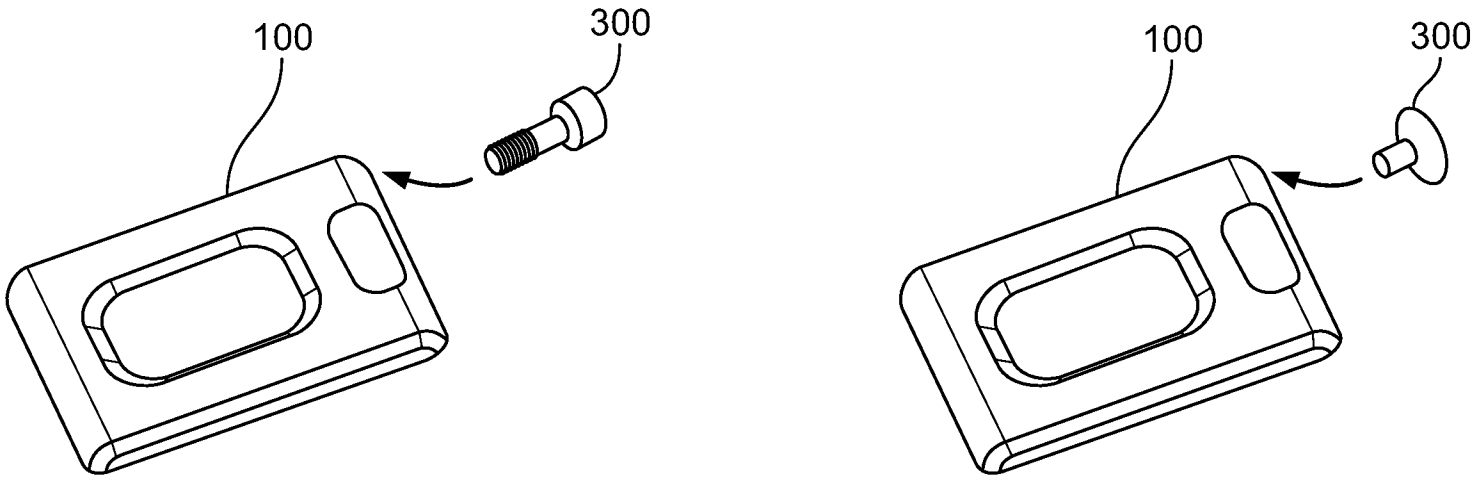
FIG. 4 shows exemplary coupling mechanisms used to couple a built-in tag or compartment to a luggage container according to an embodiment of the present invention.

Referring to FIGS. 2B, 2C, 3, and 4, the fastening element 300 may be a screw or a rivet that is coupled to the coupling portion 113 via a hole formed at the coupling portion. However, the fastening element 300 is not limited thereto. For example, as shown in FIG. 3, the coupling portion 113 penetrates a portion of the luggage container 200 to receive the fastening element 300 from inside of the luggage container, thus the compartment 100 affixed on the external surface of the luggage container 200, exposing the outer side 111 of the case 110. According to an embodiment of the present invention, a connector 310 may be placed over the coupling portion 113, wherein the connector is shaped to form a hole such that the fastening element 300 passes through the hole of the connector to be inserted into the hole of the coupling portion. Further, the connector 310 may have a flat bottom that contacts an inner surface of the luggage container 200. The hole of the connector 310 is at a top portion of the connector and the flat bottom of the connector is at a bottom portion of the connector. For example, the length of the connector 310 from the hole to the flat bottom may be about 1 cm, less than 1 cm, about 0.5 mm, or at least 0.2 mm. See FIGS. 2B, 2C, and 3.

Referring to FIGS. 1A-2C, the case 110 is shaped to form a first space between a surface of an object, such as the luggage container 200, onto which the case is coupled and a surface of the inner side 112 to receive the drawer 120. As exemplified in FIG. 2C, according to an embodiment of the present invention, the drawer 120 may be shaped to remain within the case 110 when the drawer is pulled out of the case such that the case and the drawer are not separated even when the drawer is pulled out maximally. FIG. 1B shows the open configuration in which the drawer 120 is pulled out maximally out of the case 110. According to another embodiment of the invention, the drawer 120 may be completely separated from the case 110 when the drawer is pulled out of the case.

Referring to FIGS. 2A-2C, the drawer 120 includes an inner end portion 121 that is located at an inner side of the drawer, the inner end portion not visible even when the drawer is pulled out of the case 110 and an outer end portion 122 that is located at an opposite side of the inner end portion 121, the outer end portion always exposed. In the closed confirmation, the outer side 111 of the case 110 and an outer side of the outer end portion 122 may form a single surface. According to an embodiment of the present invention, a width of the outer end portion 122 may be greater than a width of the inner end portion 121.

Referring to FIGS. 1A, 1B, and 2A, an outer surface of a bottom portion of the outer end portion 122 is at least partially recessed and an outer surface of a top portion of the case 110 is at least partially recessed such that a recess 101 is formed when the drawer 120 is inserted into the case. That is, in the closed configuration of the compartment 100, the bottom portion of the outer end portion 120 is in contact with the top portion of the case 110, the recess 101 including a portion of the outer surface of the bottom portion of the outer end portion and a portion of the outer surface of the top portion of the case. The recess 101 allows a user to open the drawer 120 more easily by placing a finger at the recess.

Referring to FIGS. 2A-2C, the drawer 120 further includes a tray 123 that is formed between the inner end portion 121 and the outer end portion 122. According to an embodiment of the present invention, an identification information sheet 124 may be affixed to the tray 123 such that the identification information sheet is exposed only when the drawer 120 is pulled out of the case 110, thus identification information protected in the closed configuration.

In case the identification information sheet 124 is affixed to the tray 123, a surface of the tray to which the identification information sheet is affixed may be flat. Referring to FIGS. 2B and 2C, according to an embodiment of the present invention, at least two protrusion lines 114 may be formed on the inner side 112 of the case 110 along a width direction of the case such that the flat surface of the tray 123 contacts the at least two protrusion lines when the drawer 120 moves along a length direction of the case. This allows tightness between the case 110 and the drawer 120, preventing accidental or unwanted opening of the drawer and requiring pulling by the user for opening of the drawer.

Referring to FIGS. 2A-2C, the tray 123 and the inner end portion 121 extending from the tray have a same thickness and form flat surfaces on both sides of the tray and the inner end portion. The outer end portion 122 extending from the tray 123 has a greater height than the tray and the inner end portion 121. As shown in FIGS. 2B and 2C, according to an embodiment of the present invention, the outer end portion 122 may have a hollow at a side of the outer end portion corresponding to a backside of the tray 123.

Figure 5:
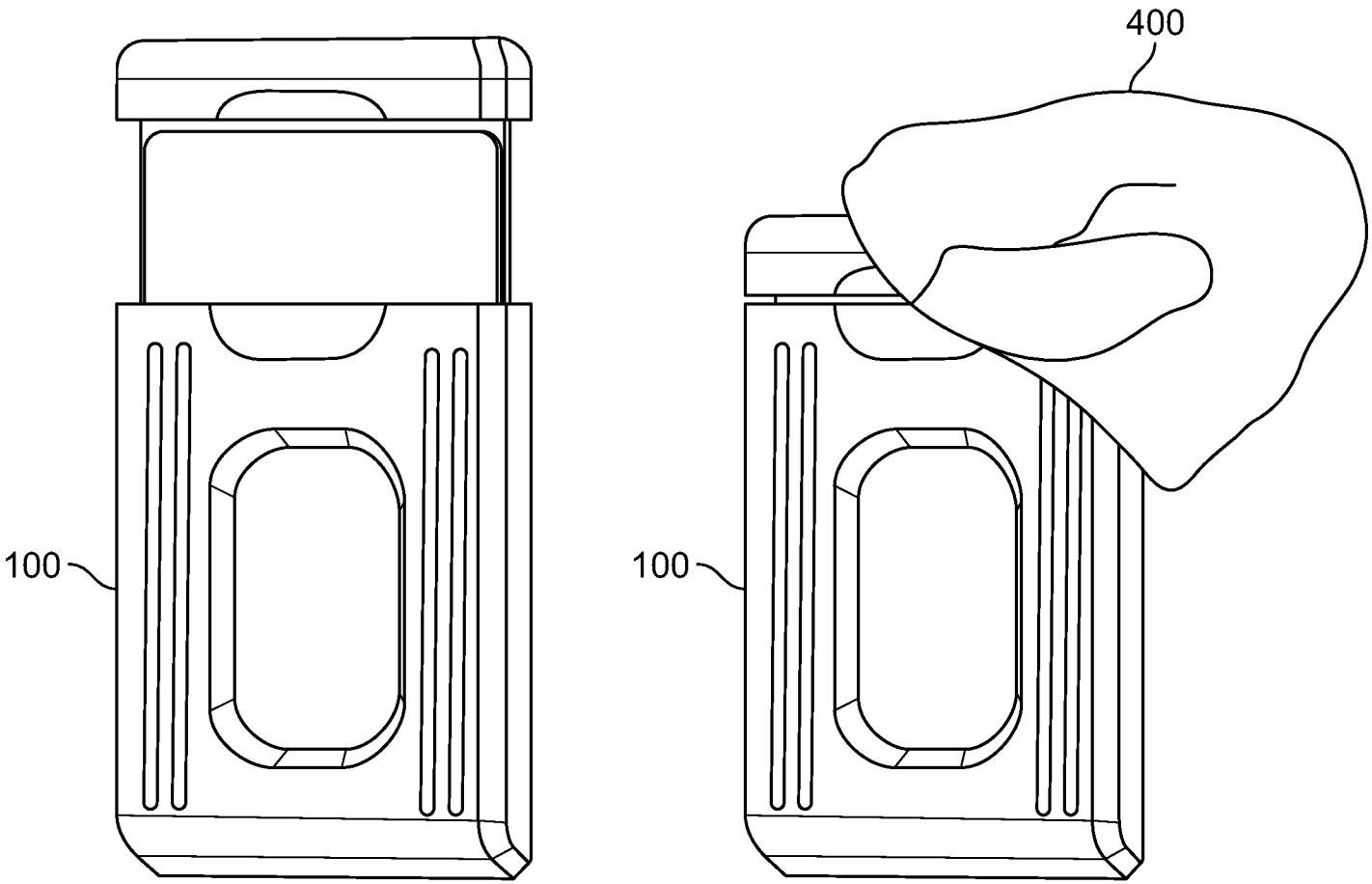
FIG. 5 shows two exemplary types of built-in tags or compartments according to alternative embodiments of the present invention.

According to an embodiment of the present invention, in addition to the first space formed between the surface of the object onto which the case 110 is coupled and the surface of the inner side into which the drawer 120 is received, a second space may be formed between a surface of the tray 123 and the surface of the inner side of the case, the second space being smaller than the first space. According to an embodiment of the present invention, the second space may be sized to receive at least one of a business card, an identification card, or a credit card such that the tray 123 of the drawer 120 is used to store the at least one of the business card, the identification card, or the credit card. See FIG. 5 showing a card taken out of the compartment 100.

For example, a thickness of the second space is at least 2 mm, 3 mm, 4 mm, or 5 mm and less than 10 mm to accommodate one or a plurality of the business card, the identification card, and the credit card. In this case, the tray 123 may have walls formed along edge portions of two lateral sides and a bottom side of the tray, the walls having a height corresponding to the thickness of the second space to accommodate the one or the plurality of the business card, the identification card, and the credit card.

Referring to FIGS. 2B and 2C, according to an embodiment of the present invention, the case 110 may have a rectangular shape and includes four coupling portions 113, each coupling portion formed at or near a corresponding corner of the case. As exemplified in the drawings, an opening of the case 110 through which the drawer 120 passes is formed between first two coupling portions 113. Further, a length of the tray 123 may be less than a length of the case 110 and a width of the tray may less than a width of the inner end portion 121 of the drawer 120. Furthermore, the width of the tray 123 may be less than a width of the outer end portion 122 of the drawer 120 and the width of the tray is sized to fit the opening of the case 110.

Moreover, as exemplified in FIG. 2C, even when the tray 123 is inserted into the case 110, lateral sides of the tray are not in contact with lateral sides of the case formed at the internal side 112 such that a gap is formed between each of the lateral sides of the tray and a corresponding one of the lateral sides of the case. The gap may be at least 1 mm or 2 mm.

Further, as shown in FIGS. 2A-2C, a right angle or a near right angle is formed by each of two protruding portions of the inner end portion 121 of the drawer 120 and a corresponding lateral side of the tray 123 such that the two protruding portions contact second two coupling portions 113 of the case 110 or the two protruding portions are positioned near corners of the case at which the second two coupling portions are formed when the drawer is inserted into the case completely. Furthermore, as shown in FIG. 2C, the two protruding portions of the inner end portion 121 of the drawer 120 contact the first two coupling portions 113 of the case 110 or the two protruding portions are positioned near corners of the case at which the first two coupling portions are formed when the drawer is pulled out of the case completely.

According to another embodiment of the present invention, as exemplified in FIG. 5, an expandable/concealable bag 400 may be stored within the compartment 100. For example, the bag 400 is expandable out of the compartment 100 when the drawer 120 is pulled out of the case 110. The bag 400 may be fixedly coupled to the compartment 100 and the bag may not be detachable from the compartment. Alternatively, the bag 400 may be detachable from the compartment 100 to be completely separated from the compartment when the drawer 120 is open, thus allowing use of the bag 400 as a backup/extra container in case additional luggage is necessary to accommodate extra stuffs that cannot fit in the luggage container 200.

As described above, the compartment 100 is attached to a luggage container 200 to be used as a built-in identification tag or as an extra compartment for storing small items such as a business card and credit card. Further, the compartment 100 may also be used to store an expandable bag 400 that can be pulled out of the compartment to carry additional items.

Those skilled in the art will appreciate that alternative embodiments exist from the above description of the embodiments without departing from the spirit and scope of the invention. The above described embodiments were shown in the context of a standard carry-on size luggage in the drawings. However, in alternative embodiments, a full size luggage or a luggage with additional compartments can be substituted for the described luggage. In addition, luggage may be made with any material that is suitable.

Therefore, the foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification and examples provide a complete description of the manufacture and use of the apparatus of the invention. Since many embodiments of the invention can be made without departing from the spirit and scope of the invention, the invention resides in the claims hereinafter appended.

What is claimed is:

1. A built-in compartment for hardcase luggage comprising:

a case having an outer side and an inner side; and a drawer configured to be slid in and out of the case, wherein:

the case comprises a coupling portion formed on the inner side, the coupling portion protruding from the inner side and penetrating a portion of a surface of the hardcase luggage;

the coupling portion is shaped to receive a fastening element;

a space is formed between the surface of the hardcase luggage onto which the case is coupled and a surface of the inner side of the case to receive the drawer; and the drawer is shaped to remain within the case when the drawer is pulled out of the case such that the case and the drawer are not separated even when the drawer is pulled out maximally.

2. The compartment of claim 1, wherein the drawer comprises:

an inner end portion that is located at an inner side of the drawer, the inner end portion not visible even when the drawer is pulled out of the case; and an outer end portion that is located at an opposite side of the inner end portion, the outer end portion always exposed.

3. The compartment of claim 2, wherein a width of the outer end portion is greater than a width of the inner end portion.

4. The compartment of claim 2, wherein:

an outer surface of a bottom portion of the outer end portion is at least partially recessed;

an outer surface of a top portion of the case is at least partially recessed; and a recess is formed when the drawer is inserted into the case such that the bottom portion of the outer end portion is in contact with the top portion of the case, the recess including a portion of the outer surface of the bottom portion of the outer end portion and a portion of the outer surface of the top portion of the case.

5. The compartment of claim 2, wherein the drawer further comprises a tray formed between the inner end portion and the outer end portion.

6. The compartment of claim 5, wherein:

an identification information sheet is affixed to the tray; and the identification information sheet is exposed when the drawer is pulled out of the case.

7. The compartment of claim 6, wherein:

a surface of the tray to which the identification information sheet is affixed is flat;

at least two protrusion lines are formed on the inner side of the case along a width direction of the case; and the flat surface of the tray faces the at least two protrusion lines when the drawer is positioned in the case.

8. The compartment of claim 5, wherein:

the tray and the inner end portion formed extendingly from the tray form flat surfaces on both sides of the tray and the inner end portion; and the outer end portion is formed extendingly from the tray and has a greater height than the tray and the inner end portion.

9. The compartment of claim 5, wherein the tray is sized to receive at least one of a business card, an identification card, or a credit card.

10. The compartment of claim 9, wherein the tray is sized to receive a plurality of business cards, identification cards, or credit cards.

11. The compartment of claim 10, wherein the tray has walls formed along edge portions of two lateral sides and a bottom side of the tray.

12. The compartment of claim 5, wherein the case has a rectangular shape and comprises four coupling portions, each coupling portion formed at or near a corresponding corner of the case.

13. The compartment of claim 12, wherein:

an opening of the case through which the drawer passes is formed between first two coupling portions;

a length of the tray is less than a length of the case;

a width of the tray is less than a width of the inner end portion of the drawer;

the width of the tray is less than a width of the outer end portion of the drawer; and the width of the tray is sized to fit the opening of the case.

14. The compartment of claim 13, wherein lateral sides of the tray are not in contact with lateral sides of the case formed at the internal side, a gap formed between each of the lateral sides of the tray and a corresponding one of the lateral sides of the case.

15. The compartment of claim 14, wherein:

a right angle or a near right angle is formed by each of two protruding portions of the inner end portion of the drawer and a corresponding lateral side of the tray;

the two protruding portions contact second two coupling portions of the case or the two protruding portions are positioned near corners of the case at which the second two coupling portions are formed when the drawer is inserted into the case completely; and the two protruding portions contact the first two coupling portions of the case or the two protruding portions are positioned near corners of the case at which the first two coupling portions are formed when the drawer is pulled out of the case completely.

16. The compartment of claim 1, further comprising a bag stored within the compartment, wherein:

the bag is expandable out of the drawer when the drawer is pulled out of the case; and the bag is coupled to the compartment or the bag is detachable from the compartment.

17. A luggage container comprising the compartment of claim 1.

18. The luggage container of claim 17, further comprising:

the fastening element comprising a screw or a rivet that is coupled to the coupling portion via a hole formed at the coupling portion, wherein the coupling portion penetrates the portion of the luggage to receive the fastening element from inside of the luggage container.

19. The luggage container of claim 18, further comprising a connector placed over the coupling portion, wherein the connector is shaped to form a hole such that the fastening element passes through the hole of the connector to be inserted into the hole of the coupling portion.

20. A hardside luggage with a built-in compartment, comprising:

a body;

a case coupled to a side of the body and having an outer side and an inner side; and a drawer configured to be slid in and out of the case, the case and the drawer forming the built-in compartment, wherein:

the case comprises a coupling portion that protrudes from the inner side of the case and penetrates the body:

the coupling portion is shaped to receive a connector and a fastening element from inside of the body;

the connector, which is placed over the protruding coupling portion, is shaped to have a hole through which the fastening element passes through to be inserted into a hole formed at the protruding coupling portion, the connector having a flat bottom that contacts an inner surface of the body;

the hole of the connector is at a top portion of the connector and the flat bottom of the connector is at a bottom portion of the connector;

a space is formed between an outer surface of the body onto which the case is coupled and an inner surface of the case to receive the drawer; and the drawer is shaped to remain within the case when the drawer is pulled out of the case such that the case and the drawer are not separated even when the drawer is pulled out maximally.

* * * * *